US005723941A

United States Patent [19]

Roelevink

[11] Patent Number: 5,723,941

[45] Date of Patent: Mar. 3, 1998

[54] LIGHTING UNIT, ELECTRODELESS LOW-PRESSURE DISCHARGE LAMP, AND DISCHARGE VESSEL FOR USE IN THE LIGHTING UNIT

[75] Inventor: Bauke J. Roelevink, Roosendaal, Netherlands

[73] Assignee: U.S. Philips Corporation, New York, N.Y.

[21] Appl. No.: 630,311

[22] Filed: Apr. 10, 1996

[30] Foreign Application Priority Data

May 24, 1995 [EP] European Pat. Off. ..... 95201371

[51] Int. Cl.[6] ..... H01J 65/00

[52] U.S. Cl. ..... 313/493; 313/634

[58] Field of Search ..... 313/234, 493, 313/607, 634; 220/2.1 R, 2.2

[56] References Cited

U.S. PATENT DOCUMENTS 4,645,967 2/1987 Bouman et al. ..... 313/248

4,745,323 5/1988 Northrop et al. ..... 313/493 X 4,797,595 1/1989 De Jong ..... 313/493

*Primary Examiner*—Hezron E. Williams

*Assistant Examiner*—Daniel S. Larkin

*Attorney, Agent, or Firm*—Walter M. Egbert, III

[57] ABSTRACT

A lighting unit is disclosed having an electrodeless low pressure discharge lamp which is provided with a discharge vessel closed in a gastight manner and comprising an ionizable filling. The discharge vessel has a recessed portion and an enveloping portion. The recessed portion and the enveloping portion each have a fastening to a metal collar, a coil being arranged in the recessed portion for generating a high-frequency magnetic field for maintaining an electric discharge in the discharge vessel. The enveloping portion is provided at an inner surface with a light-transmitting, electrically conductive layer. The conductive layer is electrically connected to a lead-through member of which the metal collar forms part in that the conductive layer covers a region of the lead-through member which adjoins the inner surface of the enveloping portion and which is at a distance from at least one of the fastenings between the discharge vessel and the collar. The lighting unit according to the invention can be efficiently manufactured, and the lead-through member forms a reliable electrical connection to the conductive layer.

20 Claims, 2 Drawing Sheets

LIGHTING UNIT, ELECTRODELESS LOW-PRESSURE DISCHARGE LAMP, AND DISCHARGE VESSEL FOR USE IN THE LIGHTING UNIT

BACKGROUND OF THE INVENTION

The invention relates to a lighting unit comprising an electrodeless low-pressure discharge lamp and a supply for said lamp, this lamp being provided with a discharge vessel which is closed in a gastight manner, which contains an ionizable filling, and which has a recessed portion and an enveloping portion, while the lamp is in addition provided with a coil positioned in the recessed portion for generating a high-frequency magnetic field during lamp operation for maintaining an electric discharge in the discharge vessel, the enveloping portion of the discharge vessel being provided with a light-transmitting, electrically conductive layer at an inner surface, and the discharge vessel having a lead-through member which is electrically connected to the conductive layer, which extends along the circumference of the inner surface of the enveloping portion of the discharge vessel, and which is accessible from outside the discharge vessel.

The invention also relates to an electrodeless low-pressure discharge lamp and to a discharge vessel for use in the lighting unit.

Such a lighting unit is known from U.S. Pat. No. 4,645,967. The supply in the known lighting unit is accommodated in a holder which is fastened to the discharge vessel and which also supports a lamp cap. An electrodeless low-pressure discharge lamp is also called "lamp" in the present description and claims. The term "high-frequency" is here understood to mean a frequency higher than 20 kHz. In the known lighting unit, the supply has a frequency of approximately 3 MHz. The supply is connected to contacts of the lamp cap. The discharge vessel of the lighting unit has a light-transmitting, electrically conductive layer, also called conductive layer hereinafter, of tin oxide doped with fluorine. A portion of the conductive layer extending between the recessed portion and the enveloping portion up to and into a zone outside the discharge vessel serves as the lead-through member. The conductive layer is covered with a further conductive layer of graphite in this zone for reinforcement. The conductive layer is connected to one of the conductors of the power mains via the lead-through member, an electrical conductor fastened to the graphite layer, and a contact of the lamp cap during operation. Interfering influences of the lighting unit on the surroundings resulting from the high-frequency operation are counteracted in this manner.

In the known lighting unit, the enveloping and the recessed portion of the discharge vessel are fastened to one another with glass enamel. The use of this connection has the disadvantage that it must harden at a temperature of a few hundred °C. for a comparatively long period after its application. The provisions necessary for this, and the space occupied by them, involve additional cost. Direct fusion of the parts of the discharge vessel, however, necessitates considerably higher temperatures. The connection between the conductive layer and the lead-through member may be broken at these temperatures.

SUMMARY OF THE INVENTION

It is an object of the invention to provide a lighting unit of the kind described in the opening paragraph which can be manufactured efficiently and in which the lead-through member forms a reliable electrical connection to the light-transmitting, electrically conductive layer.

According to the invention, a lighting unit of the kind described in the opening paragraph is for this purpose characterized in that the lead-through member comprises a metal collar surrounding an axis, which collar extends from the recessed portion to the enveloping portion and to which collar each of said portions has a fastening point, the light-transmitting, electrically conductive layer covering a region of the lead-through member which adjoins the inner surface of the enveloping portion and which is at a distance from at least one of the fastening points between the discharge vessel and the collar.

The collar may be made from a metal having a coefficient of expansion which corresponds to that of the glass of the discharge vessel, for example in the case of lime glass a CrNiFe alloy, for example Cr 6%, Ni 42%, remainder Fe (by weight). For a hard-glass lamp vessel, for example of borosilicate glass, it is possible to use, for example, a collar of Ni/Fe or of NiCoFe, for example Ni 29%, Co 17%, remainder Fe (by weight).

The lead-through member may comprise one or several further parts which are electrically connected to the collar. The conductive layer is made, for example, from tin-doped indium oxide or fluorine-doped tin oxide. The conductive layer may support a luminescent layer for converting ultraviolet radiation generated in the discharge space into visible radiation. A reflecting layer may be provided over a portion of the inner surface of the discharge vessel, for example part of the inner surface of the enveloping portion in order to focus radiation generated in the discharge space and aim it at a light emission window of the discharge vessel. The reflecting layer is made, for example, from a mixture of larger and smaller aluminium oxide particles as described in EP 639 852 A 1. Alternatively, the layer may be made from a metal, for example nickel. Such a layer is capable of supporting the action of the light-transmitting, electrically conductive layer.

The discharge vessel of the lighting unit according to the invention may be manufactured as follows. First, the fastening of the enveloping portion of the discharge vessel to the collar is realised in that this portion is fused thereto. Then the conductive layer may be provided on the inner surface of the discharge vessel such that this conductive layer extends over a region of the lead-through member which adjoins the inner surface of the enveloping portion, for example a region on the collar, so that an electrical connection between the conductive layer and the lead-through member is realised. Subsequently, the recessed portion of the discharge vessel may be fastened to the collar in that this portion is fused to the collar. Since the conductive layer extends over a region on the lead-through member which adjoins the inner surface of the enveloping portion and which is at a distance from the connection between collar and recessed portion to be formed, there will be a heat resistance between these locations. The recessed portion may therefore be fused to the collar while nevertheless the temperature of the conductive layer remains sufficiently low for retaining a reliable electrical connection between the collar and the light-transmitting, electrically conductive layer.

In a practical embodiment, the region of the lead-through member over which the conductive layer extends forms part of the collar. This renders possible a simple construction in which the collar alone can suffice as the lead-through member.

An attractive embodiment of the lighting unit according to the invention is characterized in that the collar has a first annular zone which widens conically in a direction from the enveloping portion to the collar, the enveloping portion having an end which is fused to said zone and has the same shape as said zone. These components will automatically occupy mutually concentric positions during the assembly of the collar with the enveloping portion of the discharge vessel. The manufacture of the lighting unit is simplified thereby.

The conductive layer may be provided, for example, through spraying or vapour deposition. A suspension is often used in practice for providing a layer such as a conductive layer, a luminescent layer, or a protective layer, for example a protective layer of aluminium oxide. It is favourable in that case when the collar has a second annular zone which narrows conically in a direction from the enveloping portion to the collar. Excess suspension can drain away easily in that case.

A robust construction of the discharge vessel is obtained, also with a collar of a comparatively thin material, in an embodiment wherein the second zone has a slope of between 20 and 60 degrees relative to the axis.

Preferably, the collar has an inner annular zone to which the recessed portion of the discharge vessel is fused and which lies in a plane transverse to the axis. This construction facilitates the assembly of the recessed portion with the collar.

In an attractive embodiment, the lighting unit according to the invention is characterized in that the collar has an outer annular zone which extends in a plane transverse to the axis to beyond the enveloping portion and which is provided with a raised edge. The outer annular zone with the raised edge renders possible a simple mounting of the discharge vessel to a holder, for example by a snap connection.

The relative positions occupied by the recessed portion and the enveloping portion in the assembled discharged vessel render the enveloping portion generally more easily accessible than the recessed portion. To simplify the production process, therefore, it may be desirable for the enveloping portion to be in fact the last to be fastened to the collar. An attractive embodiment of the lighting unit according to the invention renders this possible in that the region of the lead-through member over which the conductive layer extends forms part of a conductive ring which is electrically connected to the collar and which is fastened to the inner surface of the enveloping portion at a distance from the collar. The conductive ring is fastened, for example, in the enveloping portion in that the latter is fused to this ring. After the recessed portion has been fastened to the collar and the inner surface of the enveloping portion has been provided with the conductive layer, which layer also extends over a region of the ring which adjoins the inner surface of the enveloping portion and which is at a distance from the fastening to be formed between the enveloping portion and the collar, the enveloping portion may also be fused to the collar. Since said region is at a distance from the location of the fastening to be realised between the enveloping portion and the collar, the temperature of said region on the ring remains sufficiently low for retaining a reliable electrical connection between the layer and the ring during the process of fusing the enveloping portion to the collar. The electrical connection between the ring and the collar is realised, for example, in that the ring rests with clamping force on the collar, but it may alternatively be obtained, for example, by welding.

In a favourable embodiment of the lighting unit according to the invention, the collar supports an amalgam holder. The amalgam holder may be fastened to the collar, for example, by means of a welded joint, for example obtained by laser welding.

The composition of the ionizable filling is immaterial to the invention. The discharge vessel may be filled with a rare gas. The filling comprises, for example, also a metal vapour, for example sodium vapour or mercury vapour.

In an embodiment of the lighting unit according to the invention, the supply is accommodated in a holder fastened to the discharge vessel. The holder may also support a lamp cap.

Alternatively, the supply may be accommodated in a separate housing, the electrodeless lamp being connected to the supply by means of a cable. The invention accordingly also applies to an electrodeless lamp for use in the lighting unit.

The invention also relates to a discharge vessel to be used in a lighting unit according to the invention. The discharge vessel according to the invention may be detachably coupled to the holder. The discharge vessel may then be replaced by another discharge vessel, if so desired, for example a discharge vessel provided with a luminescent layer which luminesces at a different colour temperature. The holder may, for example, have a clamping contact member which cooperates with the metal collar.

BRIEF DESCRIPTION OF THE DRAWINGS

This and other aspects of the invention will be explained in more detail with reference to a drawing, in which.

DESCRIPTION OF THE PREFERRED EMBODIMENTS

Figure 1:
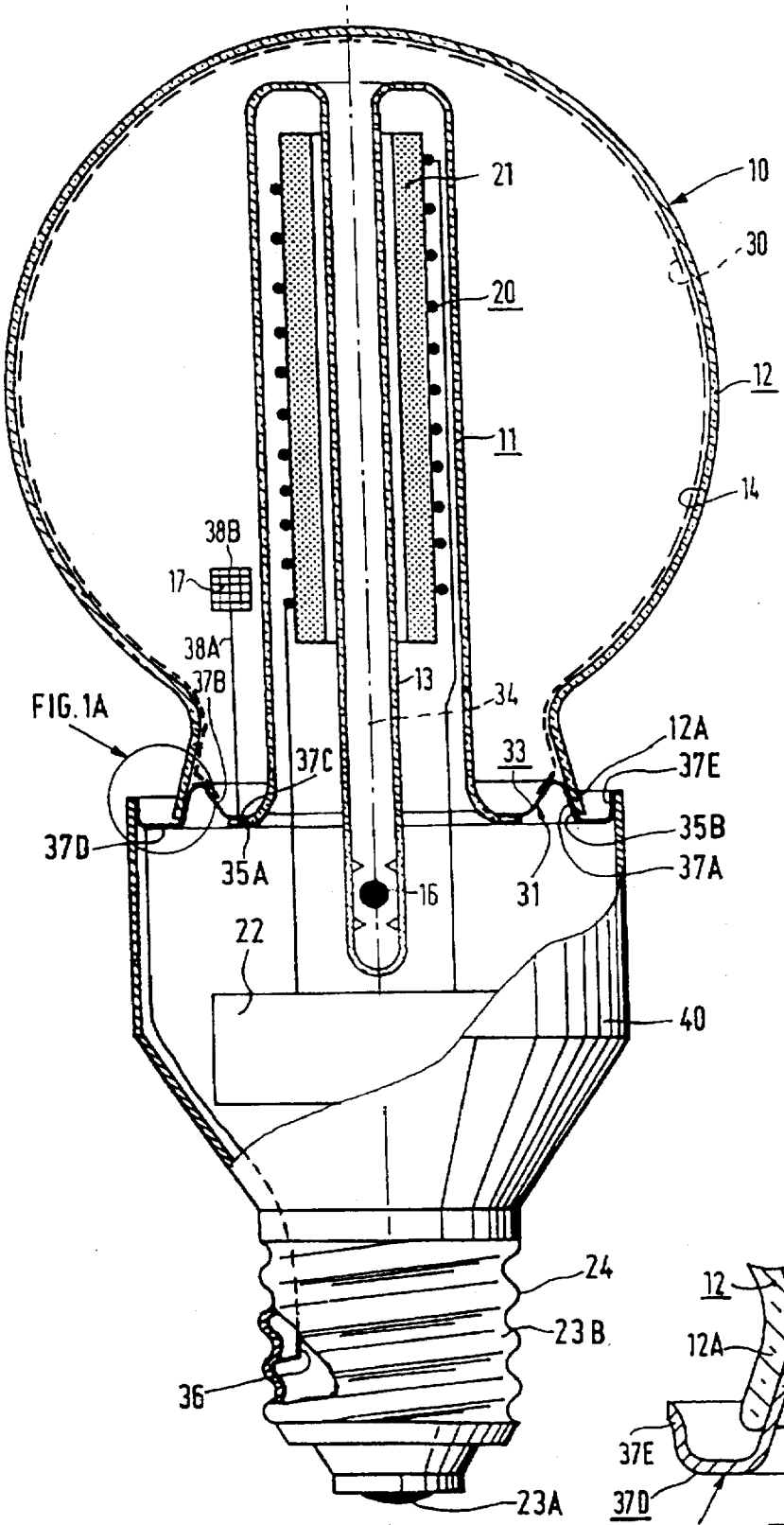
FIG. 1 shows a first embodiment of the lighting unit according to the invention in longitudinal sectional view. A detail from FIG. 1 is shown in FIG. 1A.

The lighting unit shown in FIG. 1 comprises an electrodeless low-pressure discharge lamp and a high-frequency supply 22 for the lamp. The lamp is provided with a glass discharge vessel 10 which is closed in a gastight manner and contains an ionizable filling, here a filling of mercury, argon, and krypton. The discharge vessel 10 has a recessed portion 11 and an enveloping portion 12. A coil 20 is arranged in the recessed portion 11 for generating a high-frequency magnetic field during lamp operation for maintaining an electric discharge in the discharge vessel 10. The coil 20 is wound around a core 21 of soft-magnetic material. Alternatively, a core may be absent. An exhaust tube 13 issues to the exterior in the enveloped portion 11, through the core 21 of the coil 20. The enveloping portion 12 of the discharge vessel 10 is provided on an inner surface 14 with a light-transmitting, electrically conductive layer 30 (shown in broken lines) which is electrically connected to a lead-through member 31 which extends along the circumference of the inner surface 14 of the enveloping portion 12 of the discharge vessel 10 and which is passed to the exterior from the discharge vessel 10. In the embodiment shown, the light-transmitting, electrically conductive layer 30 is made of fluorine-doped tin oxide.

The lead-through member 31 comprises around an axis 34 a metal collar 33, here made of a CrNiFe alloy, in this case 6% Cr, 42% Ni, 52% Fe by weight. The collar has a thickness of 0.35 mm. The collar extends from the recessed portion 11 to the enveloping portion 12, and each of these portions 11, 12 has a fastening 35A, 35B to this collar. The light-transmitting, electrically conductive layer 30 covers a region 32 of the lead-through member 31 which adjoins the inner surface 14 of the enveloping portion 12 and which is at a distance from at least one of the fastenings 35A, 35B between the discharge vessel 10 and the collar 33. Said region 32 here is at a distance from the fastening 35A between the recessed portion 11 of the discharge vessel 10 and the collar 33. The distance between said region 32 and the fastening 35A is great compared with the thickness of the material of the collar 33.

In the embodiment shown, the region 32 of the lead-through member 31 over which the light-transmitting, electrically conductive layer 30 extends forms part of the collar 33. A luminescent layer (not shown) is provided over the conductive layer 30. The lamp is integrated with a high-frequency supply 22 into a lighting unit. The supply 22 is accommodated in a housing 40 fastened to the discharge vessel 10 and connected to contacts 23A, 23B of a lamp cap 24 fastened to the housing 40. During operation, the light-transmitting, electrically conductive layer 30 is connected to a conductor of the power mains via the lead-through member 31, an electrical conductor 36 welded to the lead-through member, and a contact 23A of the lamp cap 24.

Figure 1A:
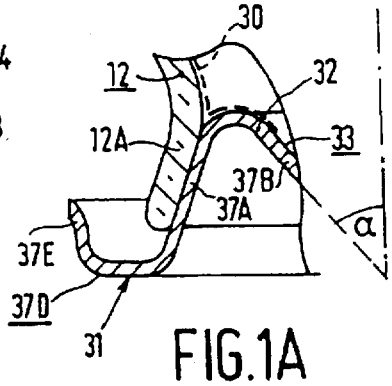

The collar 33 has a first annular zone 37A which widens cortically in a direction from the enveloping portion 12 to the collar 33, the enveloping portion 12 having an end 12A of the same shape which is fused to this zone 37A, whereby a fastening 35B is formed. Within the first annular zone 37A, there is a second annular zone 37B (see also FIG. 1A) which narrows conically in a direction from the enveloping portion 12 to the collar 33 with a slope angle $\alpha$ of 40° relative to the axis 34. The slope angle $\alpha$ accordingly lies between 20° and 60°.

The collar 33 has an inner annular zone 37C to which the recessed portion 11 of the discharge vessel 10 is fused and which lies in a plane transverse to the axis 34. The collar 33 also has an outer annular zone 37D which extends in a plane transverse to the axis to beyond the enveloping portion 12 and which is provided with a raised edge 37E. The discharge vessel 10 is mounted with the raised edge 37E of the collar 33 into the housing 40 of the lamp.

An amalgam 16 of mercury with an alloy of bismuth and indium is accommodated in an exhaust tube 13 fastened to the recessed portion 11. A holder 38B for an auxiliary amalgam 17 is also fastened to the collar 33 by means of a rod 38A. The holder 38B is made of nickel gauze in the embodiment shown. An indium layer provided thereon forms an auxiliary amalgam 17 together with mercury.

The discharge vessel 10 was manufactured as follows. First the enveloping portion 12 was fastened to the collar 33. The enveloping portion 12 of the discharge vessel 10 was for this purpose fused with its end 12A to a conically widening first annular zone 37A of the collar 33, with the auxiliary amalgam 17 fastened thereon. Then the light-transmitting, electrically conductive layer 30 and the luminescent layer were provided in that order, and the recessed portion 11 was fastened to the collar 33, i.e. fused to the inner annular zone 37C of the collar 33. After the main amalgam 16 had been provided in the exhaust tube 13, the discharge vessel 10 was cleaned and subsequently filled with a mixture of krypton and argon.

Figure 2:
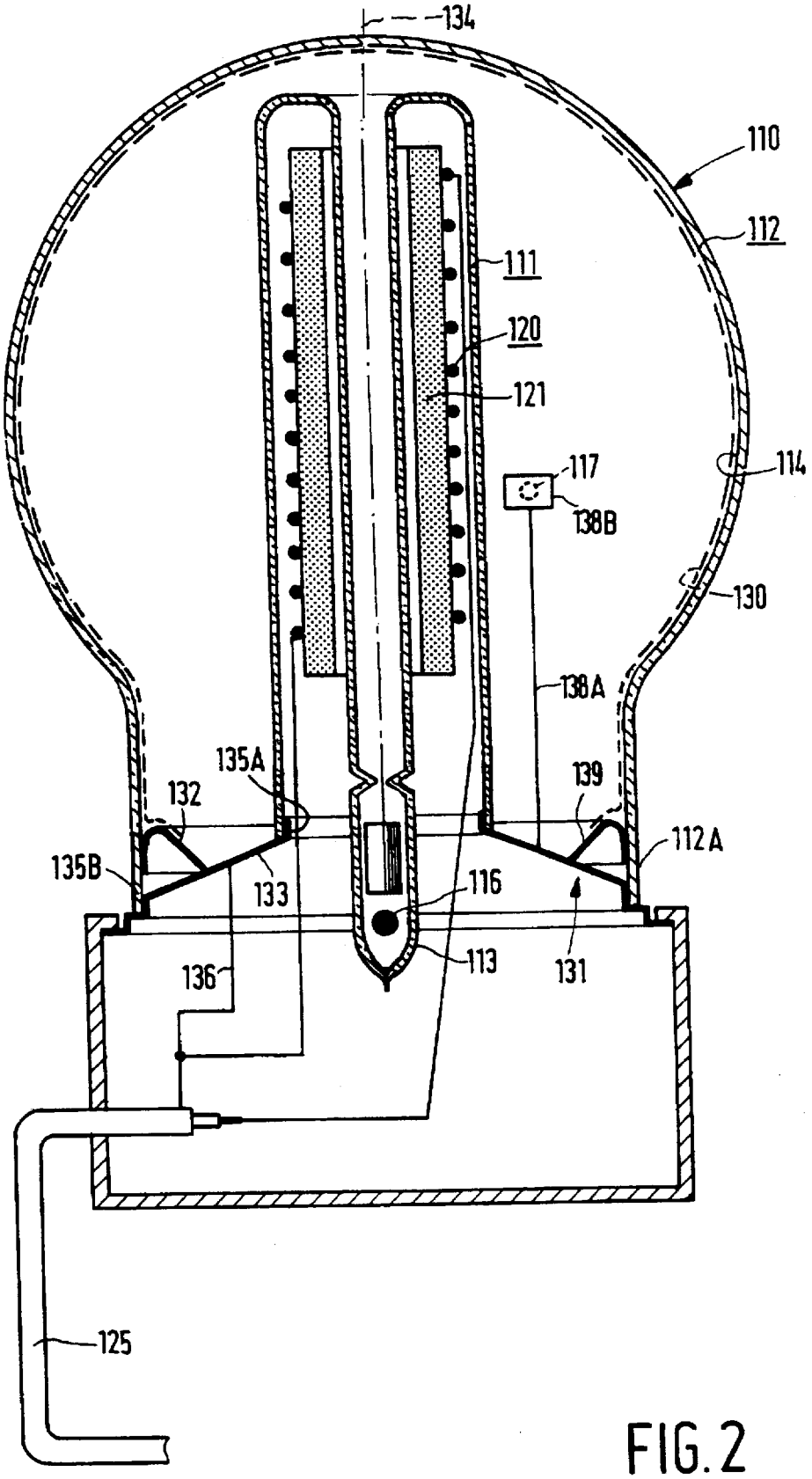
FIG. 2 shows, again in longitudinal sectional view, the lamp of a second embodiment of the lighting unit according to the invention.

In FIG. 2, components corresponding to those of FIG. 1 have reference numerals which are 100 higher. In the embodiment shown in FIG. 2, the region 132 over which the conductive layer 130 extends forms part of a conductive ring 139 which is fastened to the inner surface 114 of the enveloping portion 112 at a distance from the collar 133. The conductive layer 130 extends over a region 132 of the conductive ring 139 which adjoins the inner surface 114 of the enveloping portion 112 and which lies at a distance from the fastening 135B between the enveloping portion 112 and the collar 133. The conductive ring 139 is electrically connected to the collar 133 in that it bears resiliently on this collar 133. Alternatively, the conductive ring may be welded to the collar, for example by laser welding through a window in the discharge vessel. The collar 133 supports an amalgam holder 138B. In the embodiment shown, the lamp is connected to a supply (not shown) via a coax cable 125.

The discharge vessel 110 of the lamp shown in FIG. 2 may be manufactured as follows. First the recessed portion 111 is fastened by fusion to the collar 133. The amalgam holder 138B is fastened with its rod 138A to the collar 133, for example with laser welds. Simultaneously, the ring 139 may be fastened to the enveloping portion 112. After the ring 139 has been applied, the inner surface 114 of the enveloping portion 112 may be provided with a light-transmitting, electrically conductive layer 130, for example by vapour deposition or sputtering, or in that a suspension is made to flow over the inner surface and is dried. Then the enveloping portion 112 is also fastened to the collar 133 in that this portion 112 is fused with its end 112A to the collar 133. The discharge vessel 110 may be cleaned through the exhaust tube 113 after this and be provided with a falling. Alternatively, an exhaust tube may be absent and the discharge vessel may be closed, for example, in a space having an atmosphere of the desired composition and pressure.

What is claimed is:

1. A lighting unit comprising: an electrodeless low-pressure discharge lamp and a supply for said lamp, the lamp being provided with a discharge vessel which is closed in a gastight manner, which contains an ionizable filling, and which has a recessed portion and an enveloping portion, while the lamp in addition provided with a coil positioned in the recessed portion for generating a high-frequency magnetic field during lamp operation for maintaining an electric discharge in the discharge vessel, the enveloping portion of the discharge vessel being provided with a light-transmitting, electrically conductive layer at an inner surface, and the discharge vessel having a lead-through member which is electrically connected to the conductive layer, which extends along the circumference of the inner surface of the enveloping portion of the discharge vessel, and which is accessible from outside the discharge vessel, characterized in that: the lead-through member comprises a metal collar surrounding an axis, which collar extends from the recessed portion to the enveloping portion and to which collar each of said portions has a fastening point, the light-transmitting, electrically conductive layer covering a region of the lead-through member which adjoins the inner surface of the enveloping portion and which is at a distance from at least one of the fastening points between the discharge vessel and the collar.

2. A lighting unit as claimed in claim 1, characterized in that the region of the lead-through member over which the conductive layer extends forms part of the collar.

3. A lighting unit as claimed in claim 2, characterized in that the collar has a first annular zone which widens conically in a direction from the enveloping portion to the collar, the enveloping portion having an end which is fused to said zone and has the same shape as said zone.

4. A lighting unit as claimed in claim 3, characterized in that the collar has a second annular zone which narrows conically in a direction from the enveloping portion to the collar.

5. A lighting unit as claimed in claim 4, characterized in that the second zone has a slope of between 20 and 60 degrees relative to the axis.

6. A lighting unit as claimed in claim 5, characterized in that the collar has an inner annular zone to which the recessed portion of the discharge vessel is fused and which lies in a plane transverse to the axis.

7. A lighting unit as claimed in claim 6, characterized in that the collar has an outer annular zone which extends in a plane transverse to the axis to beyond the enveloping portion and which is provided with a raised edge.

8. A lighting unit as claimed in claim 1, characterized in that the region of the lead-through member over which the conductive layer extends forms part of a conductive ring which is electrically connected to the collar and which is fastened to the inner surface of the enveloping portion at a distance from the collar.

9. A lighting unit as claimed in claim 3, characterized in that the collar supports an amalgam holder.

10. An electrodeless low-pressure discharge lamp as defined in claim 1 for use in a lighting unit as claimed in that same claim.

11. A discharge vessel as defined in claims 1 for use in a lighting unit as claimed in that same claim.

12. A lighting unit as claimed in claim 2, characterized in that the collar has an annular zone which narrows conically in a direction from the enveloping portion to the collar.

13. A lighting unit as claimed in claim 12, characterized in that said annular zone which narrows cortically from the enveloping portion to the collar has a slope of between 20 and 60 degrees relative to the axis.

14. A lighting unit as claimed in claim 12, characterized in that the collar has an inner annular zone to which the recessed portion of the discharge vessel is fused and which lies in a plane transverse to the axis.

15. A lighting unit as claimed in claim 12, characterized in that the collar has an outer annular zone which extends in a plane transverse to the axis to beyond the enveloping portion and which is provided with a raised edge.

16. A lighting unit as claimed in claim 2, characterized in that the collar has an inner annular zone to which the recessed portion of the discharge vessel is fused and which lies in a plane transverse to the axis.

17. A lighting unit as claimed in claim 2, characterized in that the collar has an outer annular zone which extends in a plane transverse to the axis to beyond the enveloping portion and which is provided with a raised edge.

18. A lighting unit as claimed in claim 3, characterized in that the collar supports an amalgam holder.

19. A lighting unit as claimed in claim 4, characterized in that the collar supports an amalgam holder.

20. A lighting unit as claimed in claim 5, characterized in that the collar supports an amalgam holder.

* * * * *